US008640790B2

(12) United States Patent
MacDougall et al.

(10) Patent No.: US 8,640,790 B2
(45) Date of Patent: Feb. 4, 2014

(54) APPARATUS, SYSTEM AND METHOD FOR MOTION COMPENSATION USING WIRED DRILL PIPE

(75) Inventors: Tom MacDougall, Sugar Land, TX (US); Harold Steven Bissonnette, Sugar Land, TX (US); Christopher S. Del Campo, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 562 days.

(21) Appl. No.: 12/720,128

(22) Filed: Mar. 9, 2010

(65) Prior Publication Data

US 2010/0224360 A1 Sep. 9, 2010

Related U.S. Application Data

(60) Provisional application No. 61/158,664, filed on Mar. 9, 2009.

(51) Int. Cl.
*E21B 7/128* (2006.01)

(52) U.S. Cl.
USPC ..... 175/7; 175/40; 166/250.01; 702/9

(58) Field of Classification Search
USPC ..... 166/355, 250.01, 66; 414/139.6; 175/7, 175/40; 702/9, 17; 73/152.45; 367/82, 31, 367/75; 181/102, 106
See application file for complete search history.

(56) References Cited

U.S. PATENT DOCUMENTS 4,559,709 A 12/1985 Beseme et al.
4,852,052 A * 7/1989 Frey et al. ..... 702/9
5,209,302 A * 5/1993 Robichaux et al. ..... 166/355
5,433,276 A 7/1995 Martain et al.
5,894,895 A * 4/1999 Welsh ..... 175/5
6,641,434 B2 11/2003 Boyle et al.
6,866,306 B2 3/2005 Boyle et al.
7,069,775 B2 7/2006 Fredette et al.
7,131,210 B2 11/2006 Fredette et al.
7,224,288 B2 5/2007 Hall et al.
7,331,386 B2 2/2008 Kanayama et al.
7,413,021 B2 8/2008 Madhavan et al.
7,424,912 B2 9/2008 Reid
2008/0083564 A1 4/2008 Collins
2008/0156486 A1 7/2008 Ciglenec et al.
2008/0156537 A1 * 7/2008 Stockton ..... 175/58
2008/0266577 A1 10/2008 Provoust et al.
2008/0290617 A1 11/2008 Bounds
2008/0296017 A1 12/2008 Sonne et al.
2008/0314587 A1 12/2008 Del Campo et al.
2009/0000823 A1 1/2009 Pirovolou
2009/0133881 A1 * 5/2009 Roodenburg et al. ..... 166/355
2009/0166087 A1 7/2009 Braden et al.
2009/0242317 A1 10/2009 Tashiro et al.

* cited by examiner

*Primary Examiner* — Yong-Suk (Philip) Ro
(74) *Attorney, Agent, or Firm* — Kimberly Ballew

(57) ABSTRACT

An apparatus, a system and a method for motion compensation use wired drill pipe to transmit downhole measurements from downhole tools to the surface. The wired drill pipe may transmit control signals from a terminal located at the surface to the downhole tools. In response to the control signals, a motion compensation component may enable the drill string to compensate for motion, such as, for example, heave. The motion compensation component may change a length of the drill string. A downhole tool having arms may be connected to the drill string and the wired drill pipe. The control signals may direct the downhole tool to move between an extended position and a retracted position.

10 Claims, 9 Drawing Sheets

APPARATUS, SYSTEM AND METHOD FOR MOTION COMPENSATION USING WIRED DRILL PIPE

This application claims the benefit of U.S. Provisional Application Ser. No. 61/158,664 entitled "WIRED DRILL PIPE FOR STATION LOG MEASUREMENTS" and filed Mar. 9, 2009.

BACKGROUND OF THE INVENTION

The present invention generally relates to an apparatus, a system and a method for motion compensation using wired drill pipe. The wired drill pipe may transmit measurements from downhole tools to the surface and control signals from a terminal located at the surface to the downhole tools. The measurements and the control messages may enable the drill string to compensate for motion, such as, for example, heave.

To obtain hydrocarbons in water environments, a wellbore may be drilled in a subsea floor using a drill string lowered from a floating platform, such as, for example, a drilling ship or a floating rig. The drill string is a continuous length of pipe made by connecting segments of pipe end to end. The drill string may be suspended from the floating platform by a hoisting system. The drill string is driven into the subsea floor to form the wellbore through which the hydrocarbons are extracted. A drill bit is attached at a lower end of the drill string, and a bottom hole assembly (BHA) is located proximate to the drill bit.

The BHA consists of tools which generate and/or obtain measurements related to wellbore operations, such as, for example, drift of the drill bit, inclination and azimuth. For example, it is known in the art to use "wireline" conveyable well logging instruments using drill pipe as the conveyance. Such conveyance is used where gravity alone is insufficient to move the logging instruments along the wellbore when conveyed by armored electrical cable ("wireline"). Such conveyance has particular application in highly inclined wellbores. See, for example, U.S. Pat. No. 5,433,276 issued to Martain et al.

It is also known in the art to use "logging while drilling" ("LWD") instruments. LWD instruments are disposed in one or more drill collars which are thick-walled segments of pipe having threaded connections at the longitudinal ends of the segments. The collars are coupled into the drill string such that lowering the drill string into the wellbore moves the LWD instruments past formations adjacent to the drill string. The sensors of the LWD instruments may obtain measurements of selected properties of the formations.

The floating platform intermittently moves up and down as a result of wave motion, known to one having ordinary skill in the art as "heave." The heave of the floating platform creates difficulties in conducting the wellbore operations and may require that the wellbore operations cease. For example, the heave of the floating platform may damage the drill string and the tools connected to the drill string.

More specifically, the distance between the floating platform and the subsea floor may be variable due to the heave of the floating platform. Therefore, upward movement of the floating platform induced by the heave may raise the drill string in the wellbore, and downward movement of the floating platform may lower the drill string in the wellbore. Raising and lowering the drill string in response to the heave may damage the drill string and the tools. For example, raising the drill string may impart tensile stress to the drill string, and lowering the drill string may impart compressive stress to the drill string.

In addition, the heave may prevent the drill bit from maintaining a position at the bottom of the wellbore. For example, each time a wave raises the floating platform, the floating platform may pull the drill bit in an upward direction, and each time a wave lowers the floating platform, the floating platform may push the drill bit in a downward direction. Thus, the heave may vary the weight-on-bit, may lift the drill bit away from the bottom of the borehole, and may damage the drill bit by forcing the drill bit against the bottom of the borehole.

Accordingly, a failure to effectively respond to the heave may be costly. The heave may create a need to replace or repair the drill string and the tools and may ultimately decrease hydrocarbon production from the wellbore operations.

Technology for transmitting information from the tools while the tools are located within the wellbore, known as telemetry technology, is used to transmit the measurements from the tools of the BHA to the floating platform for analysis. U.S. Pat. Nos. 6,641,434 and 6,866,306 to Boyle et al., both assigned to the assignee of the present application and incorporated by reference in their entireties, describe a wired drill pipe joint that is a significant advance in the wired drill pipe art for reliably transmitting measurement data in high-data rates, bidirectionally, between a surface station and locations in the wellbore. The '434 patent and the '306 patent disclose a low-loss wired pipe joint in which conductive layers reduce signal energy losses over the length of the drill string by reducing resistive losses and flux losses at each inductive coupler. The wired pipe joint is robust in that the wired pipe joint remains operational in the presence of gaps in the conductive layer. Advances in the drill string telemetry art provide opportunity for innovation where prior shortcomings of range, speed, and data rate have previously been limiting on system performance. Accordingly, wired drill pipe may enable rapid transmission of signals that may be used for improved motion compensation.

DETAILED DESCRIPTION OF THE PRESENTLY PREFERRED EMBODIMENTS

The present invention generally relates to an apparatus, a system and a method for motion compensation using wired drill pipe. The wired drill pipe may transmit measurements from downhole tools to the surface and control signals from a terminal located at the surface to the downhole tools. In response to the control signals transmitted by the wired drill pipe, a slip joint may enable the drill string to compensate for motion, such as, for example, heave. A motion compensation component may be connected to the tool string and may be capable of compensating for heave. For example, a control signal may be transmitted from the surface to activate the motion compensation component to compensate for heave.

Figure 1:
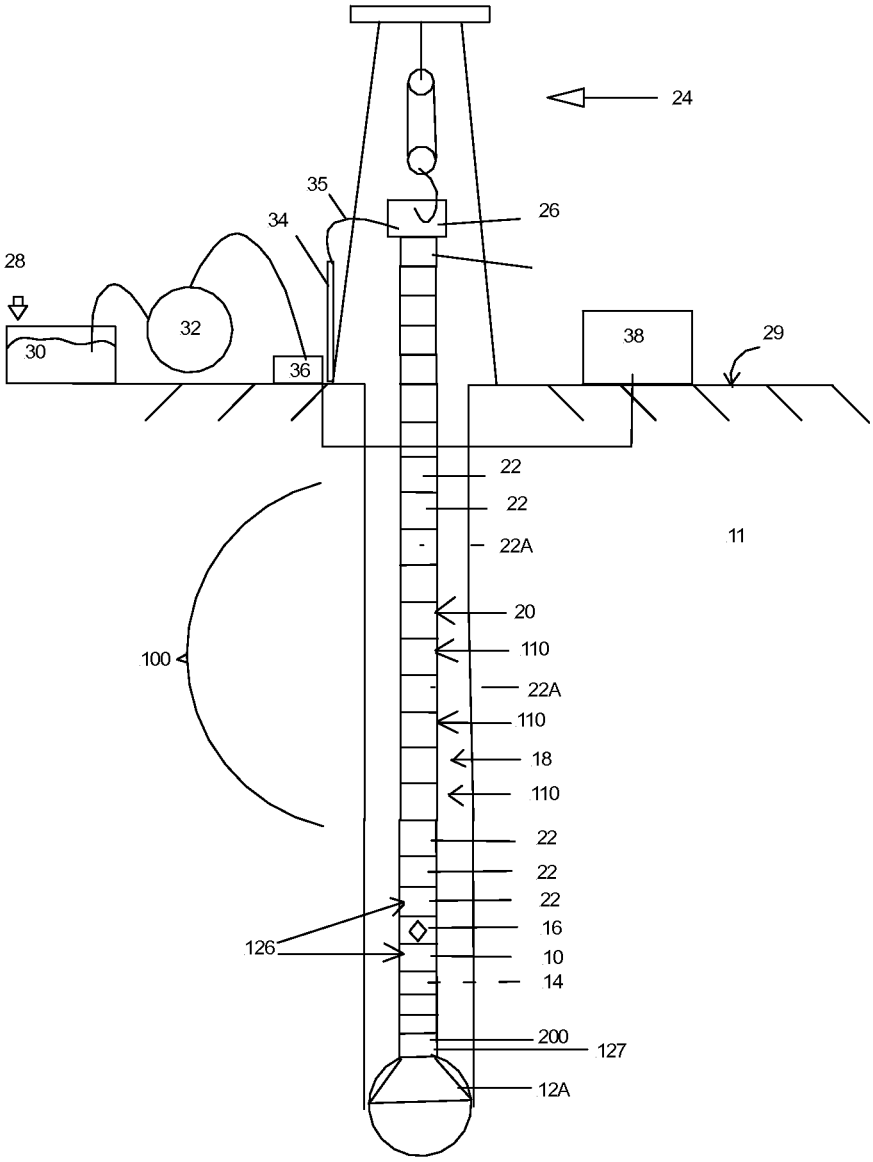
FIG. 1 illustrates a drill string having a motion compensation component extending into a wellbore in an embodiment of the present invention.

Referring now to the drawings wherein like numerals refer to like parts, FIG. 1 generally illustrates a drilling rig 24 located at the surface 29. The drilling rig 24 may suspend a drill string 20 within a wellbore 18. As used herein, the terms "up," "down," "above," "below," "upper" and "lower" indicate relative positions using the drilling rig 24 as the top point and the bottom of the wellbore 18 as the lowest point.

"The wellbore 18 may extend through subsurface formations 11. The drill string 20 may be formed by joints 22 of drill pipe connected to each other. The drill string 20 may have a drill bit 12A which may be located at the lower end of the drill string 20. If the drill bit 12A is axially urged into the subsurface formations 11 at the bottom of the wellbore 18 and/or rotated by equipment, such as, for example, a top drive 26 located on the drilling rig 24, the drill bit 12A may axially extend the wellbore 18. The top drive 26 may be substituted in other embodiments by a swivel, a kelly, a kelly bushing, a rotary table and/or the like. Accordingly, the present invention is not limited to use with top drive drilling systems."

During drilling of the wellbore 18, a pump 32 may lift drilling fluid 30 from a drilling fluid tank 28. The pump 32 may direct the drilling fluid 30 under pressure through a standpipe 34, a flexible hose 35 and/or the top drive 26 and into an interior passage (not shown separately in FIG. 1) inside the drill string 20. The drilling fluid 30 may exit the drill string 20 through nozzles (not shown separately) in the drill bit 12, thereby cooling and lubricating the drill bit 12 and lifting drill cuttings generated by the drill bit 12 to the Earth's surface.

Figure 2:
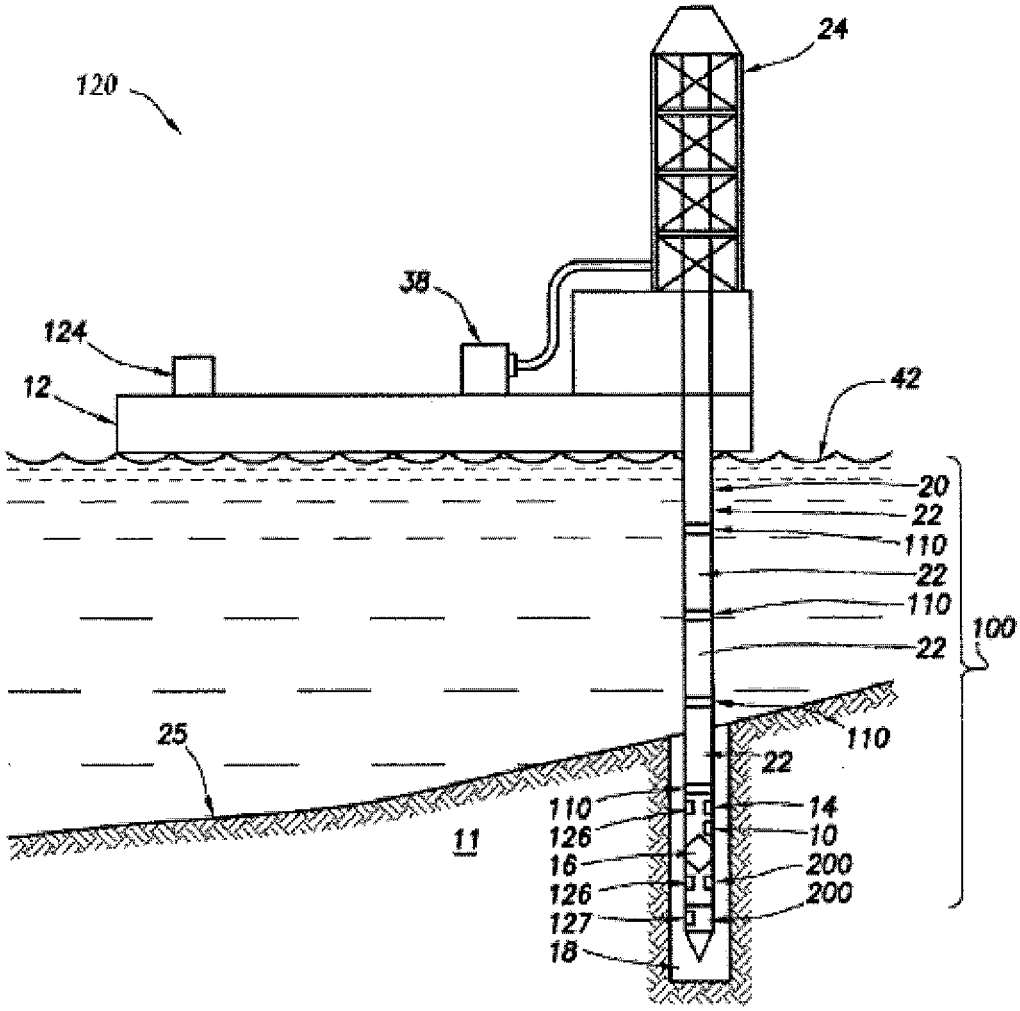
FIG. 2 illustrates a subsea drilling system having a motion compensation component in an embodiment of the present invention.

FIG. 2 generally illustrates a subsea drilling system 120 in an embodiment of the present invention. The subsea drilling system 120 may have a platform 12 which may support the drilling rig 24 and/or may suspend the drill string 20 in the wellbore 18. The platform 12 may be a floating platform, a vessel and/or any structure adapted for conducting wellbore drilling operations. For example, the platform 12 may be a semi-submersible drilling facility. The platform 12 may be positioned on a water surface 42 and/or above a subsea floor 25 in which the wellbore 18 may be located. The platform 12 may move in relation to the subsea floor 25 in response to wave action and/or tidal changes of the water surface 42, and the present invention is not limited to a specific location of the platform 12 relative to the wellbore 18.

Referring to FIGS. 1 and 2, a motion compensation component 16 may be located within the wellbore 18 and/or may be mechanically connected to the drill string 20. The motion compensation component 16 may enable the drill string 20 to compensate for movement of the drill string 20 relative to the wellbore 18 and/or motion-induced axial stress as discussed in more detail hereafter. For example, the motion compensation component 16 may enable downward movement of a portion of the drill string 20 above the motion compensation component 16 while limiting or preventing the compressive force applied to a portion of the drill string 20 below the motion compensation component 16. Similarly, the motion compensation component 16 may enable upward movement of a portion the drill string 20 above the motion compensation component 16 while preventing or limiting movement of a portion of the drill string 20 below the motion compensation component 16. The motion compensation component 16 may be any device capable of compensating or preventing heave downhole.

Tools 200 may be associated with the drill string 20. The tools 200 may measure, may record and/or may transmit data acquired from and/or through the wellbore 18 (hereinafter "the data"). The data may relate to the drill string 20, the wellbore 18 and/or the formation 11 that surrounds the wellbore 18. For example, the data may relate to one or more characteristics of the formation 11, the borehole 30 and/or the drill string 20. In a preferred embodiment, the data may indicate an inclination and/or an azimuth. The data may be measured and/or may be obtained at predetermined time intervals, at predetermined depths, at request by a user and/or the like. The present invention is not limited to a specific embodiment of the data.

One or more of the tools 200 may be, for example, logging while drilling ("LWD") instruments 10, measuring while drilling ("MWD") instruments, or other instruments or tools as known in the art. The LWD instruments 10 may have a pressure sensor 14 which may be configured to measure pressure in the annular space between the drill string 20 and the wall of the wellbore 18.

In an embodiment, a telemetry unit (not shown) may modulate the flow of the drilling fluid 30 through the drill string 20. Such modulation may cause pressure variations in the drilling fluid 30 that may be detected at the surface by a pressure transducer 36. The pressure transducer 36 may be located at a selected position between the outlet of the pump 32 and the top drive 26 as shown in FIG. 1. The transducer 36 may measure the pressure variations, and/or the transducer 36 may communicate pressure variation measurements to a terminal 38 for decoding and interpretation using techniques well known in the art. The decoded pressure variation measurements may provide the data obtained by the tools 200. For the present invention, the mud flow modulation telemetry is described only to show that such telemetry may be used in addition to wired drill pipe as discussed in detail hereafter. Therefore, the present invention may operate in the presence or the absence of mud flow modulation telemetry.

Referring again to FIGS. 1 and 2, the tools 200 may be electrically connected to the terminal 38. The terminal 38 may be located at the surface 29 and/or on the platform 12. Alternatively, the terminal 38 may be located remotely, and information may be transmitted from the drilling site to the terminal 38. For example, a transmitter (not shown) located at the drilling site may wirelessly transmit the data to the terminal 38. The terminal 38 may be any device or component for receiving, analyzing and/or manipulating the data. The terminal 38 preferably has a processor for processing the data. The terminal 38 may receive the data from the tools 200 and/or may transmit the control signals to the tools 200. The control signals may be based on user input accepted by the terminal 38 and/or may be automatically generated in response to the data received by the terminal 38. The terminal 38 may determine a position and/or an orientation of one or more of the tools 200 based on the data transmitted from the one or more of the tools 200. The present invention is not limited to a specific embodiment of the terminal 38, and the drilling system 10 may have any number of terminals.

A portion of the drill string 20 may comprise wired drill pipe 100 having one or more wired drill pipe joints 110 (hereafter "the WDP joints 110"). The WDP joints 110 may be interconnected to form the drill string 20. The wired drill pipe 100 may enable the tools 200 to communicate with the terminal 38 with a signal communication conduit communicatively coupled at each end of each of the WDP joints 110. For example, the wired drill pipe 100 preferably has an electrical and/or optical conductor extending at least partially within the drill pipe with inductive couplers positioned at the ends of each of the WDP joints 110. The wired drill pipe 100 permits communication of the data from the tools 200 to the terminal 38. Examples of wired drill pipe that may be used in the present invention are described in detail in U.S. Pat. Nos. 6,641,434 and 6,866,306 to Boyle et al. and 7,413,021 to Madhavan et al. and U.S. Patent App. Pub. No. 2009/0166087 to Braden et al., assigned to the assignee of the present application and incorporated by reference in their entireties. The present invention is not limited to a specific embodiment of the wired drill pipe 100 and/or the WDP joints 110. The wired drill pipe 100 may be any telemetry system capable of transmitting the data from the tools 200 and transmitting the control signals to the tools 200 as known to one having ordinary skill in the art.

The drill string 20 may have signal repeaters 22A located at selected positions along the length of the drill string 20. The signal repeaters 22A may receive and re-transmit signals communicated in either direction along the drill string 20. Accordingly, the signal repeaters 22A may ensure sufficient signal amplitude for the tools 200 to detect signals transmitted to and from the terminal 38 using the wired drill pipe 100. An example of a structure for the signal repeaters 22A is described in U.S. Pat. No. 7,224,288 to Hall et al. The signal repeaters 22A may or may not be needed, depending on, among other factors, the depth of the wellbore 18. Therefore, the present invention may operate in the presence or the absence of the signal repeaters 22A.

Figure 3:
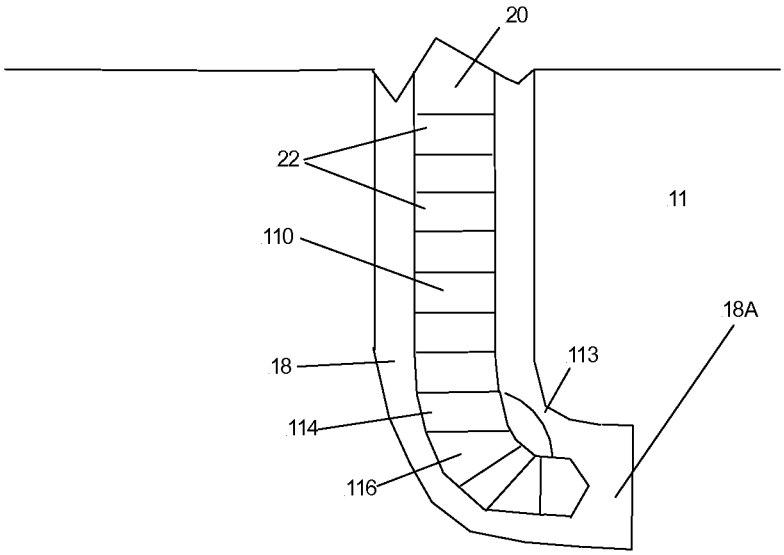
FIG. 3 illustrates a drill string in an embodiment of the present invention.

FIG. 3 illustrates an embodiment of the drill string 20 having the wired drill pipe 100. If the wellbore 18 was drilled to a selected depth, the drill string 20 may be withdrawn from the wellbore 18. Then, an adapter sub 112 and/or a wireline conveyable well-logging instrument string 113 may be coupled to the end of the drill string 20. The drill string 20 may be reinserted into the wellbore 18 so that the well-logging instrument string 113 having one or more of the tools 200 may be moved through a portion of the wellbore 18, such as, for example, a highly inclined portion 18A of the wellbore 18 which may be inaccessible using "wireline" to move the tools 200. Of course, the wellbore 18 may be drilled with the wired drill pipe 100 having the well-logging instrument string 113. During well-logging operations, the pump 32 may be operated to provide fluid flow to operate one or more turbines (not shown) located in the well-logging instrument string 113 to provide power to operate devices in the well-logging instrument string 113. Batteries, fuel cells and/or other downhole power sources may be used instead of or in addition to turbines to power the well-logging instrument string 113.

Figure 7:
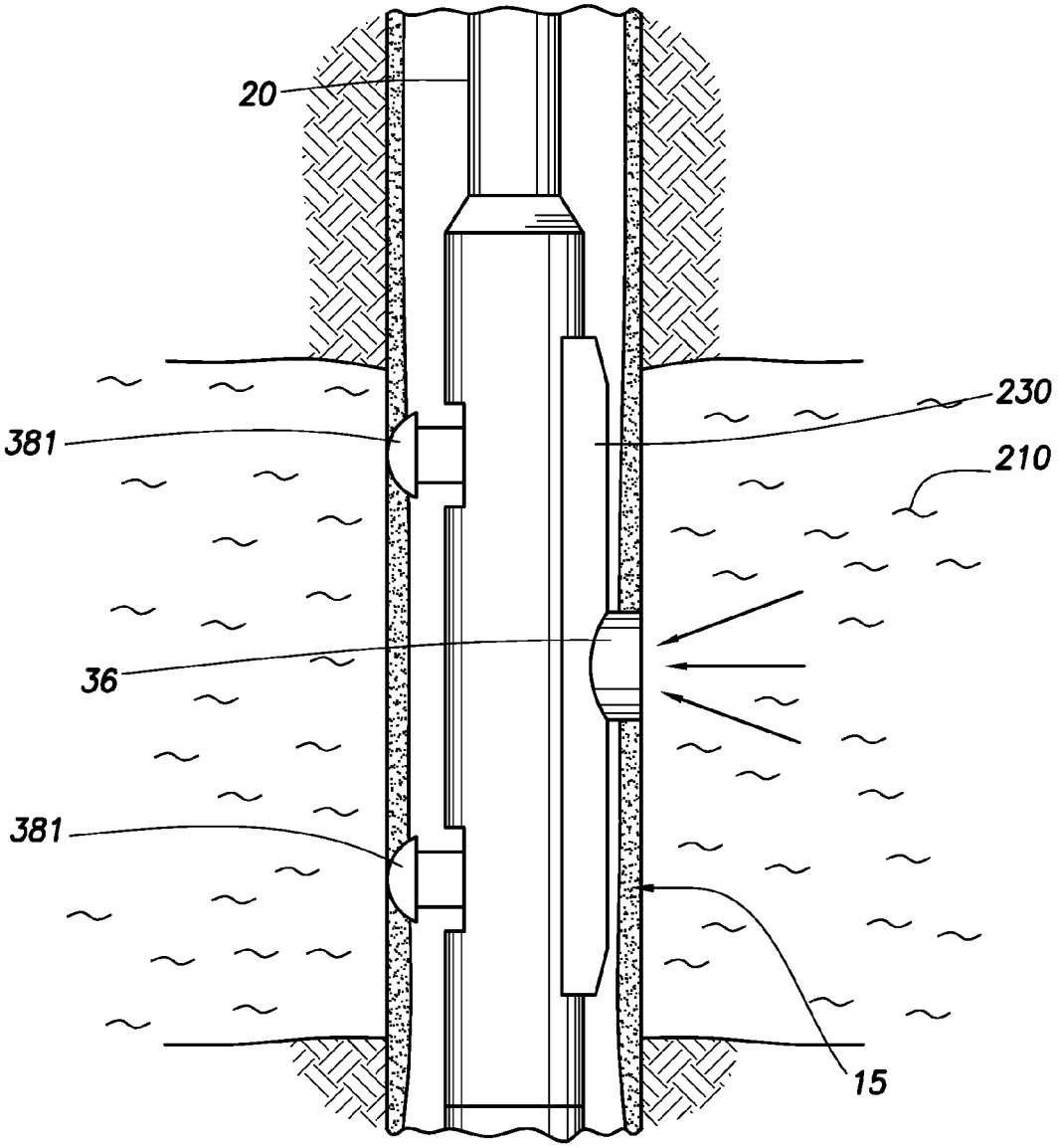
FIGS. 7, 8 and 9 illustrate downhole tools in embodiments of the present invention.
Figure 8:
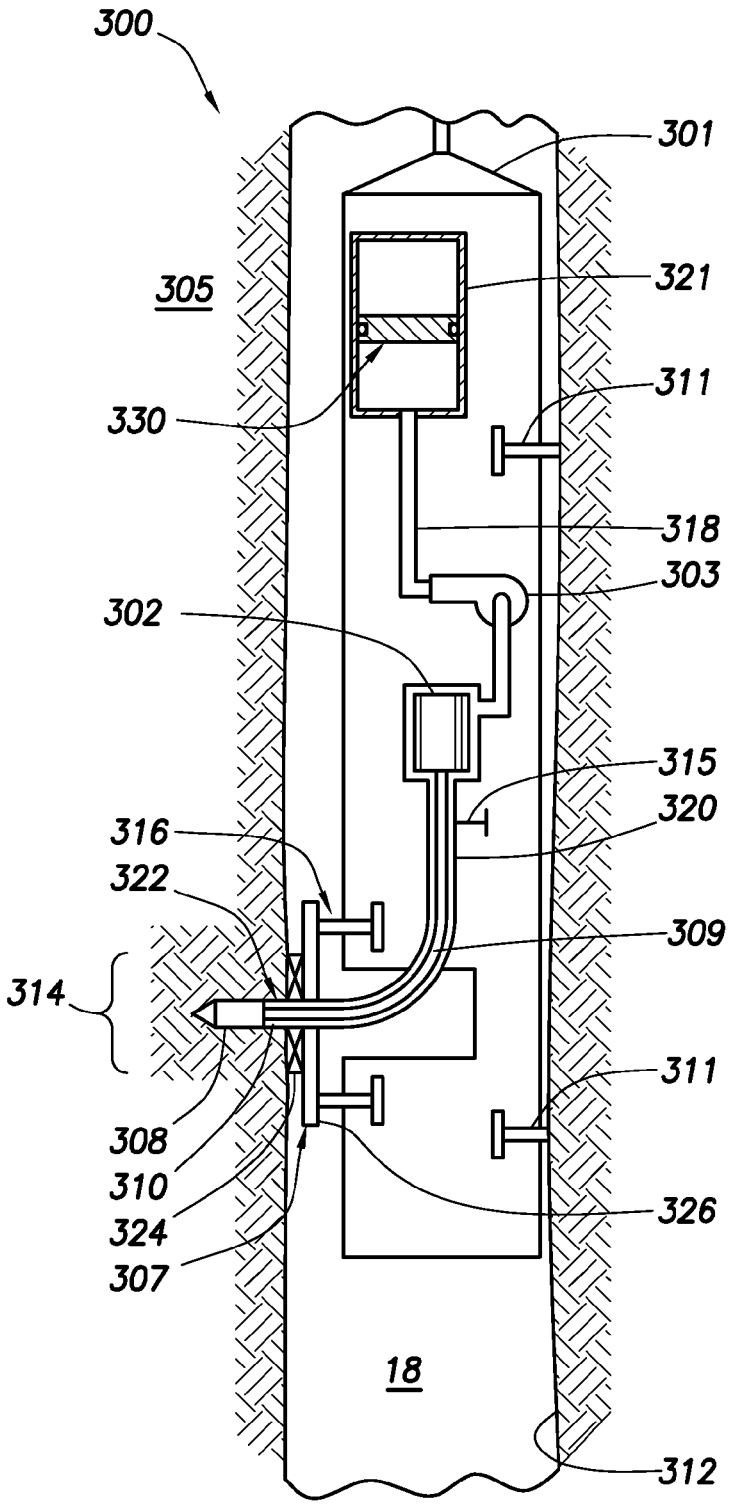

The well-logging instrument string 113 may have various devices, such as, for example, an induction resistivity instrument 116, a gamma ray sensor 114 and/or a formation fluid sample taking device discussed in more detail in reference to FIGS. 7 and 8. Other devices which may be present in the well-logging instrument string 113 are, without limitation, density sensors, neutron porosity sensors, acoustic or velocity sensors, seismic sensors, neutron induced gamma spectroscopy sensors and/or microresistivity (imaging) sensors. The well-logging instrument string 113 may generate the data as the well-logging instrument string 113 is moved along the wellbore 18 and/or to an area of interest in the wellbore 18.

An adapter sub 112 may connect the well-logging instrument string 113 to the wired drill pipe 100 to enable transmission of the data to the terminal 38. Alternatively, the well-logging instrument string 113 may connect directly to the wired drill pipe 100. The present invention is not limited to specific embodiments of the devices of the well-logging instrument string 113.

The adapter sub 112 may provide a mechanical coupling between the lowermost threaded connection on the drill string 20 and an uppermost connection on the well-logging instrument string 113. The mechanical coupling is explained in more detail hereafter in reference to FIGS. 4 and 5. In an embodiment, the adapter sub 112 may have and/or may function as the motion compensation component 16. The adapter sub 112 may also have one or more devices for producing electrical and/or hydraulic power (not shown) to operate various parts of the well-logging instrument string 113. The adapter sub 112 may have signal processing and recording devices (not shown) for selecting signals provided by the well-logging instrument string 113 for transmission to the terminal 38 using the wired drill pipe 100. The adapter sub 112 may record signals provided by the well-logging instrument string 113 in a suitable storage or recording device (not shown) in the adapter sub 112.

Referring to FIGS. 1-3, in an embodiment of the present invention, the pressure sensor 14 may obtain fluid pressure measurements for the annular space between the drill string 20 and the wall of the wellbore 18. The pressure sensor 14 may use the wired drill pipe 100 to transmit the fluid pressure measurements to the terminal 38 substantially in real time. The fluid pressure measurements may be related to, among other factors, the density of the drilling fluid 30; the vertical depth of the pressure sensor 14 in the wellbore 18; the amount of drill cuttings suspended in the drilling fluid 30; the rate at which the drilling fluid 30 moves through the drill string 20 and the annular space (known as "pumping rate" to those having skill in the art); and/or the rheological properties of the drilling fluid 30, such as, for example, the viscosity of the drilling fluid 30. Typically, the expected annulus pressure can be estimated with reasonable precision based on measurements of these factors, such as, for example, by inputting the measurements into a fluid flow simulation model.

During drilling, the fluid pressure measurements may be observed, and variations of the fluid pressure measurements from the expected annulus pressure may indicate that formation fluid has entered the wellbore 18 and/or that the drilling fluid 30 has entered one or more of the subsurface formations 11. For example, reduced annulus pressure may be a result of influx of gas from a particular formation. If the terminal 38 observes such changes in the annulus pressure, corrective action may be automatically taken by the terminal 38. The terminal 38 may automatically change one or more drilling operating parameters, such as, for example, by increasing the density of the drilling fluid 30 to avoid further influx of gas and/or by changing the operating rate of the pump 32.

As another example, an equivalent circulating density (hereinafter "the ECD") of the drilling fluid 30 may be calculated based on the fluid pressure measurements. The ECD may be based on the density of the drilling fluid 30, the flow rate of the drilling fluid 30, the viscosity of the drilling fluid 30 and/or the amount of suspended drill cuttings in the drilling fluid 30. In this example, the ECD may be calculated during drilling by communicating the fluid pressure measurements to the terminal 38 using the wired drill pipe 100. The ECD changing by more than a threshold amount may indicate that the drilling fluid 30 is too laden with drill cuttings, in which case drilling is progressing too quickly, and/or may indicate that the drilling fluid 30 has insufficient drill cuttings, in which case drilling is progressing too slowly. In either case, the rate of release of the drill string 20 may be controlled, and/or the rate at which the pump 32 is operated may be controlled to cause the ECD to remain at a selected value or within a selected operating range.

One or more of the tools 200 may be designed to operate in two or more positions relative to the drill string 20 (hereinafter "a movable tool"). A tool positioner (not shown) may mechanically connect the movable tool to the drill string 20.

The tool positioner may be, for example, a passive tool positioner which may position the movable tool according to gravity and/or an active tool positioner which may position the movable tool using mechanical means, such as, for example, hydraulic means, and/or electromechanical means, such as, for example, an electromagnetic field. The present invention is not limited to a specific embodiment of the tool positioner.

A portion of the data transmitted to the terminal 38 using the wired drill pipe 100 may indicate a position and/or an orientation of the movable tool, such as, for example, an inclination and/or an azimuth. In response to receiving the position and/or the orientation of the tools 200, the terminal 38 may automatically adjust a trajectory and/or a rotation of the drill string 20 as disclosed in U.S. Patent App. Pub. No. 2009/0000823 to Pirovolou and U.S. Patent App. Pub. No. 2008/0083564 to Collins, respectively, both assigned to the assignee of the present application and incorporated by reference in their entireties. In response to receiving the position and/or the orientation of the movable tool, the terminal 38 may automatically adjust the position of the movable tool.

The control signals transmitted from the terminal 38 may relate to the position of the movable tool. For example, the terminal 38 may transmit one or more of the control signals to the tool positioner using the wired drill pipe 100. The terminal 38 may automatically transmit the one or more of the control signals to the tool positioner in response to the data received from the tools 200. The tool positioner may adjust the position of the movable tool based on the one or more of the control signals sent by the terminal 38 to the tool positioner using the wired drill pipe 100. For example, the tool positioner may be a clutch device which may respond to a first control signal by allowing the movable tool to move and/or may respond to a second control signal by preventing the movable tool from moving. The terminal 38 may use the one or more control signals to direct the tool positioner to adjust a position of and/or align a sensor, a servicing tool, completion equipment, a liner, a screen, drainage equipment and/or the like. The terminal 38 may use the one or more control signals to steer and/or service the drill string 20.

Referring again to FIG. 2, platform heave sensors 124 may be rigidly connected to the platform 12 such that the platform heave sensors 124 do not move relative to the platform 12. The platform heave sensors 124 may be electrically connected to the terminal 38. The platform heave sensors 124 may provide platform heave measurements to the terminal 38. For example, the platform heave sensors 124 may be devices capable of measuring acceleration, speed and/or position of the platform 12. The platform heave sensors 124 may be any device, sensor or other component capable of measuring motion and/or heave that may affect the drill string 20.

In an embodiment, downhole stress sensors 126 may be located in the wellbore 18 as generally shown in FIGS. 1 and 2. The downhole stress sensors 126 may be associated with and/or may be mechanically connected to the drill string 20. In an embodiment, the downhole stress sensors 126 may be located in the well-logging instrument string 113 depicted in FIG. 3.

Referring to FIGS. 1-3, the downhole stress sensors 126 may be electrically connected to the wired drill pipe 100 and/or a downhole processor 127. The downhole stress sensors 126 may obtain downhole stress measurements. For example, the downhole stress sensors 126 may be any devices capable of measuring tension, compression, acceleration, speed, and/or position of the drill string 20. The platform heave sensors 124 and/or the downhole stress sensors 126 may be and/or may have an accelerometer, a speed sensor, a strain gauge, a load cell and/or the like, for example. The present invention is not limited to a specific embodiment of the platform heave sensors 124 or the downhole stress sensors 126. The platform heave sensors 124 and the downhole stress sensors 126 may be any devices capable of obtaining the platform heave measurements and the downhole stress measurements, respectively, known to one having ordinary skill in the art.

The downhole stress sensors 126 may transmit the downhole stress measurements to the terminal 38 using the wired drill pipe 100. A portion of the data transmitted to the terminal 38 by the wired drill pipe 100 may be the downhole stress measurements. The downhole stress sensors 126 may transmit the downhole stress measurements to the downhole processor 127. For example, the downhole stress sensors 126 may transmit the downhole stress measurements to the downhole processor 127 using the wired drill pipe 100. The terminal 38 may transmit the platform heave measurements to the downhole processor 127 using the wired drill pipe 100. Accordingly, the platform heave sensors 124, the downhole stress sensors 126, the terminal 38 and/or the downhole processor 127 may function as heave detectors and/or motion detectors.

The motion compensation component 16 may provide a mechanism for disconnecting a portion of the drill string 20 above the motion compensation component 16 from a portion of the drill string 20 below the motion compensation component 16. For example, the motion compensation component 16 may have a swivel feature to decouple rotation of a section of the drill string 20 from an adjacent section of the drill string 20, such as, for example, the well-logging instrument string 113. The motion compensation component 16 may enable rotation of other joints 22 of the drill string 20 relative to the well-logging instrument string 113, such as, for example, rotation of a portion of the drill string 20 above the motion compensation component 16 relative to a portion of the drill string 20 below the motion compensation component 16. Rotation of one or more of the joints 22 of the drill string relative to the well-logging instrument string 113 may prevent damage to the drill string 20, the tools 200 and/or the well-logging instrument string 113 during heave and/or motion. The control signals transmitted from the terminal 38 using the wired drill pipe 100 may control the motion compensation component 16. For example, one or more of the control signals may direct the motion compensation component 16 to enable rotation.

Accordingly, the motion compensation component 16 may enable a portion of the drill string 20 above the motion compensation component 16 to rotate and/or move axially while the portion of the drill string 20 below the motion compensation component does not rotate or move axially. Thus, the motion compensation component 16 may maintain a position of the tools 200 and/or the well-logging instrument string 113 relative to the wellbore 18, and the tools 200 and/or the well-logging instrument string 113 may transmit the data during heave of the platform 12 and/or motion of the drill string 20.

Conversely, the motion compensation component 16 may be substantially rigid to avoid vibration or other undesirable motion as the drill string 20 is withdrawn from the wellbore 18. For example, the motion compensation component 16 may resist and/or may prevent rotation of one or more of the joints 22 of the drill string 20 relative to other joints 22 of the drill string 20, such as, for example, the well-logging instrument string 113. The control signals transmitted from the terminal 38 using the wired drill pipe 100 may control the motion compensation component 16. For example, one or more of the control signals may direct the motion compensation component 16 to resist and/or prevent rotation.

Figure 4:
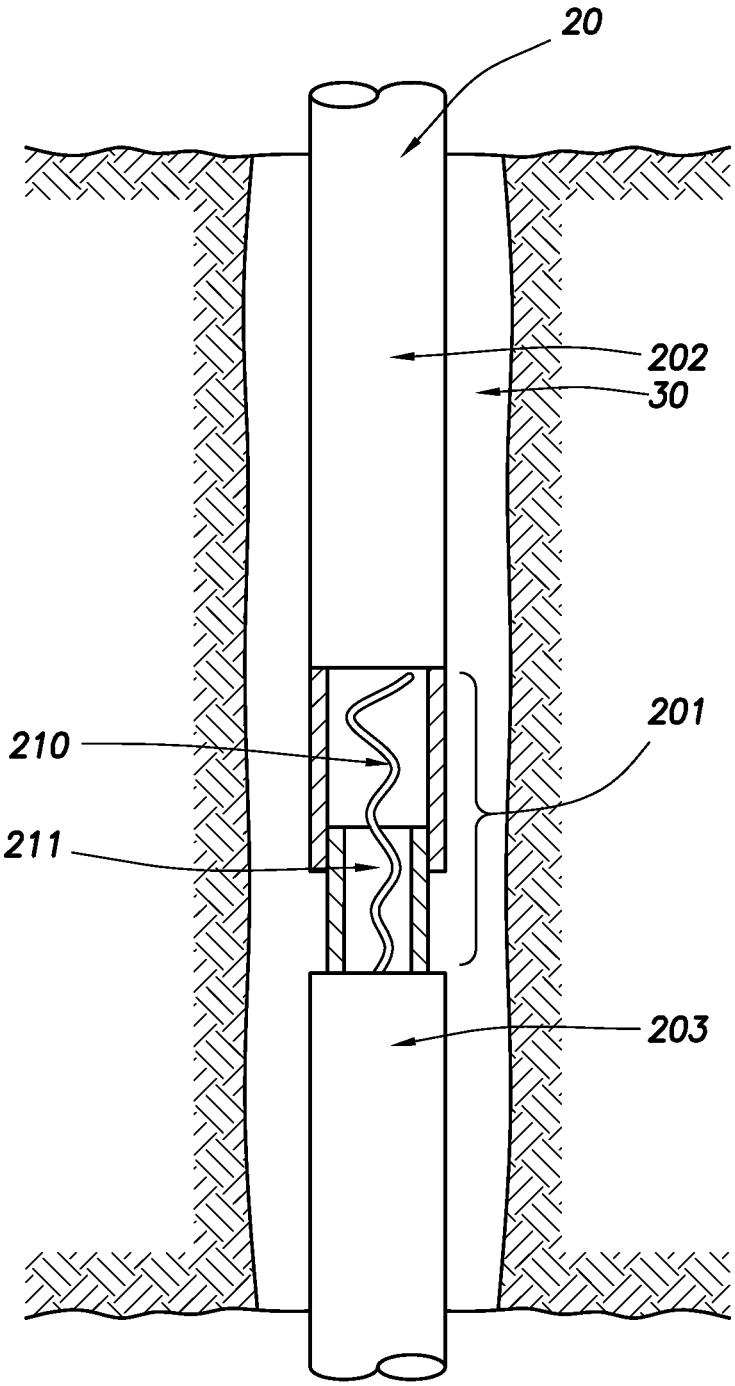
FIGS. 4 and 5 illustrate a motion compensation component in embodiments of the present invention.

As generally illustrated in FIG. 4, an embodiment of the motion compensation component 16 may have and/or may incorporate a slip joint 201. A first joint 202 of the drill string 20 and a second joint 203 of the drill string 20 may be located adjacent to the slip joint 201 such that the slip joint 201 may be located between the first joint 202 and the second joint 203. The slip joint 201 may enable the first joint 202 of the drill string 20 to move axially and/or to rotate relative to the second joint 203 of the drill string 20. More specifically, the slip joint 201 may enable the first joint 202 to move in a first axial direction and/or in a second axial direction opposite to the first axial direction. For example, the slip joint 201 may enable the first joint 202 to move toward the second joint 203 and/or away from the second joint 203.

In an embodiment, the slip joint 201 may have a locking mechanism (not shown) which may engage the first joint 202 and/or the second joint 203 to prevent the first joint 202 of the drill string 20 from rotating or moving axially relative to the second joint 203 of the drill string 20. The locking mechanism may disengage the first joint 202 and/or the second joint 203 to enable the first joint 202 of the drill string 20 to rotate and/or move axially relative to the second joint 203 of the drill string 20. The present invention is not limited to a specific position of the first joint 202 relative to the second joint 203; for example, the first joint 202 may be located above or may be located below the second joint 203 on the drill string 20.

In an embodiment, the slip joint 201 may contain magneto-rheological fluid 211, such as, for example, a fluid having a viscosity which may be changed by adjusting an intensity of an electromagnetic field applied to the fluid. In an embodiment, the magneto-rheological fluid 211 may have 20% to 40% percent by volume of carbonyl iron particles. The carbonyl iron particles may have a diameter of one to fifteen microns, may have surface hydroxyl groups, and/or may be suspended in a carrier liquid, such as, for example, mineral oil, synthetic oil, water and/or glycol. In an embodiment, the magneto-rheological fluid 211 may have a stabilizing agent, such as for example, lithium stearate, aluminum stearate and/or another metal soap.

Increasing the intensity of the electromagnetic field applied to the magneto-rheological fluid 211 may increase the viscosity of the magneto-rheological fluid 211. Decreasing the intensity of the electromagnetic field applied to the magneto-rheological fluid 211 may decrease the viscosity of the magneto-rheological fluid 211. The present invention is not limited to a specific embodiment of the magneto-rheological fluid 211, and the magneto-rheological fluid 211 may be any fluid having a viscosity which may be controlled by an electromagnetic field as known to one having ordinary skill in the art.

The slip joint 201 may have a coil 210 which may be continuously wrapped around the slip joint 201. The coil 210 may conduct electricity applied to the coil 210 to generate an electromagnetic field. The coil 210 may be electrically connected to the wired drill pipe 100. An amount of electricity applied to the coil 210 may be adjusted to control the intensity of the electromagnetic field generated by the coil 210. For example, the downhole processor 127 may control the intensity of the electromagnetic field by adjusting the amount of electricity applied to the coil 210. The amount of electricity applied to the coil 210 may be adjusted to control the viscosity of the magneto-rheological fluid 211.

The magneto-rheological fluid 211 and/or the electromagnetic field generated by the coil 210 may be used to control axial movement of the first joint 202 relative to the second joint 203. An increased viscosity of the magneto-rheological fluid 211 may resist the axial movement of the first joint 202 relative to the second joint 203. A decreased viscosity of the magneto-rheological fluid 211 may assist and/or may enable the axial movement of the first joint 202 relative to the second joint 203.

For example, increasing the electricity applied to the coil 201 may increase the intensity of the electromagnetic field, which may increase the viscosity of the magneto-rheological fluid 211. The increased viscosity of the magneto-rheological fluid 211 may prevent and/or may resist axial movement of the first joint 202 relative to the second joint 203. Decreasing the electricity applied to the coil 201 may decrease the intensity of the electromagnetic field, which may decrease the viscosity of the magneto-rheological fluid 211. The decreased viscosity of the magneto-rheological fluid 211 may encourage and/or may enable axial movement of the first joint 202 relative to the second joint 203.

Figure 5:
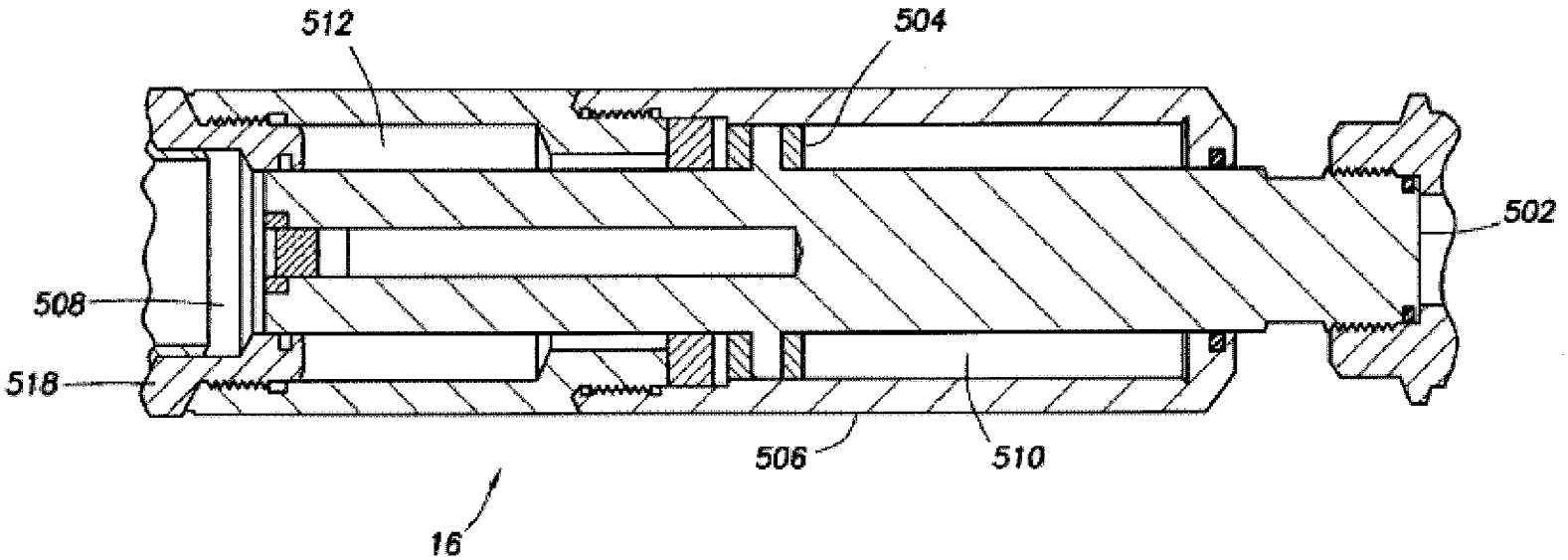

As generally illustrated in FIG. 5, an embodiment of the motion compensation component 16 may have a cylindrically shaped housing 506 which may connect to the lowermost end of the drill string 20 using a threaded connection 518 at one end of the housing 506. The housing 506 may define hydraulic chambers 510, 512 through which a piston 504 coupled to a connecting rod 502 may travel longitudinally. The hydraulic chambers 510, 512 and/or the piston 504 may act to resist elongation or contraction during a heave or other motion. The piston 504 may have an internal passage which connects to a control orifice 508. The control orifice 508 may have a variable opening that can be operated by the control signals from the terminal 38 and/or may be controlled by the downhole processor 127 in response to the data. The chambers 510, 512 may be filled with the magneto-rheological fluid 211 such that the viscosity may be changed by selective application of a magnetic field as described previously.

The amount of damping provided by the motion compensation component 16 may be selectively controlled. For example, the damping may be reduced and/or may be substantially eliminated during movement of the drill string 20 into the wellbore 18 to enable compression to protect the well-logging instrument string 113. When the drill string 20 is withdrawn from the wellbore 18, the damping may be increased to make the motion compensation component 16 substantially rigid, thereby reducing undesirable motion of the drill string 20 and/or the well-logging instrument string 113 within the drill string 20. For example, if the motion compensation component 16 is rigid, the motion compensation component 16 may resist and/or may prevent expanding the motion compensation component 16 longitudinally such that large tensile force may be required to expand the motion compensation component 16.

If the motion compensation component 16 enables a portion of the drill string 20 above the motion compensation device 16 to move toward a portion of the drill string 20 below the motion compensation device 16, the length of the drill string 20 may decrease. Decreasing the length of the drill string 20 may decrease motion-induced compressive stress on the drill string 20. If the motion compensation component 16 enables a portion of the drill string 20 above the motion compensation device 16 to move away from a portion of the drill string 20 below the motion compensation device 16, the length of the drill string 20 may increase. Increasing the length of the drill string 20 may decrease motion-induced tensile stress on the drill string 20. Moreover, increasing and/or decreasing the length of the drill string 20 may maintain a position of the tools 200 and/or the well-logging instrument string 113 relative to the wellbore 18, and the tools 200 and/or the well-logging instrument string 113 may transmit the data during heave of the platform 12 and/or motion of the drill string 20.

The motion compensation component 16 may be controlled in response to the heave of the platform 12 and/or motion-induced axial stress on the drill string 20. For example, the motion compensation component 16 may be controlled by motion response messages which may direct the motion compensation component 16 to reduce and/or increase damping. The motion response messages may be messages automatically transmitted from the downhole processor 127 and/or may be one or more of the control signals automatically transmitted from the terminal 38. The motion response messages transmitted from the terminal 38 and/or the downhole processor 127 may be based on the platform heave measurements, the downhole stress measurements, or a combination of the platform heave measurements and the downhole stress measurements. For example, if both the terminal 38 and the downhole processor 127 generate the motion response messages, the terminal 38 and the downhole processor 127 may function as a motion detector and an additional motion detector, respectively.

The terminal 38 may use the wired drill pipe 100 to transmit the motion response messages to the motion compensation component 16 based on a determination that the platform 12 experiences heave. Further, the terminal 38 may use the wired drill pipe 100 to transmit the motion response messages based on a determination that the drill string 20 has motion-induced axial stress. The downhole processor 127 may use the wired drill pipe 100 to transmit the motion response messages to the motion compensation component 16.

The motion response messages may start, stop, change and/or modify operation of the motion compensation component 16. For example, the motion response messages may direct the motion compensation component 16 to engage or disengage the first joint 202 and/or the second joint 203; increase or decrease the intensity of the electromagnetic field; and/or increase or decrease a size of the control orifice 508. In an embodiment, the terminal 38 and/or the downhole processor 127 may transmit a first motion response message to activate the motion compensation component 16 if the terminal 38 and/or the downhole processor 127 determine that the platform 12 experiences heave and/or the drill string 20 has motion-induced axial stress. Then, the terminal 38 and/or the downhole processor 127 may transmit a second motion response message to deactivate the motion compensation component 16 if the terminal 38 and/or the downhole processor 127 determine that the heave is completed and/or the drill string 20 does not have motion-induced axial stress. In another embodiment, the motion response messages sent from the terminal 38 and/or the downhole processor 127 may initiate a first response, a second response or a third response of the motion compensation component 16 if the terminal 38 and/or the downhole processor 127 determine that the platform 12 experiences motion-induced compressive stress, motion-induced tensile stress or does not have motion-induced axial stress, respectively.

One or more of the tools 200 may extend from the drill string 20 such that movement of the drill string 20 may contact the one or more tools 200 with the wellbore 18. Contacting the one or more tools 200 which may extend from the drill string 20 with the wellbore 18 may damage the one or more tools 200. The motion response messages transmitted by the terminal 38 and/or the downhole processor 127 with the wired drill pipe 100 may control orientation of the one or more of the tools 200 which may extend from the drill string 20.

For example, the motion response messages may retract the one or more tools 200 which may extend from the drill string 20 to prevent and/or to minimize contact of the one or more tools 200 with the wellbore 18. In an embodiment, the terminal 38 and/or the downhole processor 127 may transmit a first motion response message using the wired drill pipe 100. For example, the first motion response message may be automatically transmitted if the terminal 38 and/or the downhole processor 127 determine that the platform 12 experiences heave and/or the drill string 20 has motion-induced axial stress. The one or more tools 200 which may extend from the drill string 20 may retract in response to receipt of the first motion response message.

Then, the terminal 38 and/or the downhole processor 127 may transmit a second motion response message. For example, the second motion response message may be automatically transmitted if the terminal 38 and/or the downhole processor 127 determine that the heave is completed and/or the motion-induced axial stress is removed. The terminal 38 and/or the downhole processor 127 may transmit the second motion response message using the wired drill pipe 100. The one or more tools 200 which may extend from the drill string 20 may move to an extended position in response to the second motion response message. Accordingly, the terminal 38 and/or the downhole processor 127 may direct the one or more tools 200 which may extend from the drill string 20 to move between a first position and a second position in response to heave and/or motion.

Figure 6B:
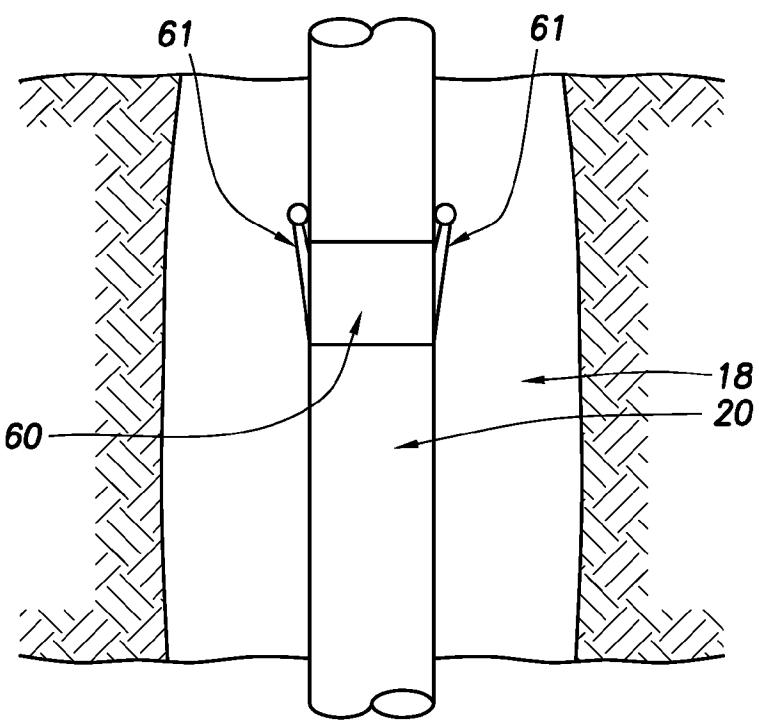
FIGS. 6A and 6B illustrate a downhole tool in an embodiment of the present invention.
Figure 6A:
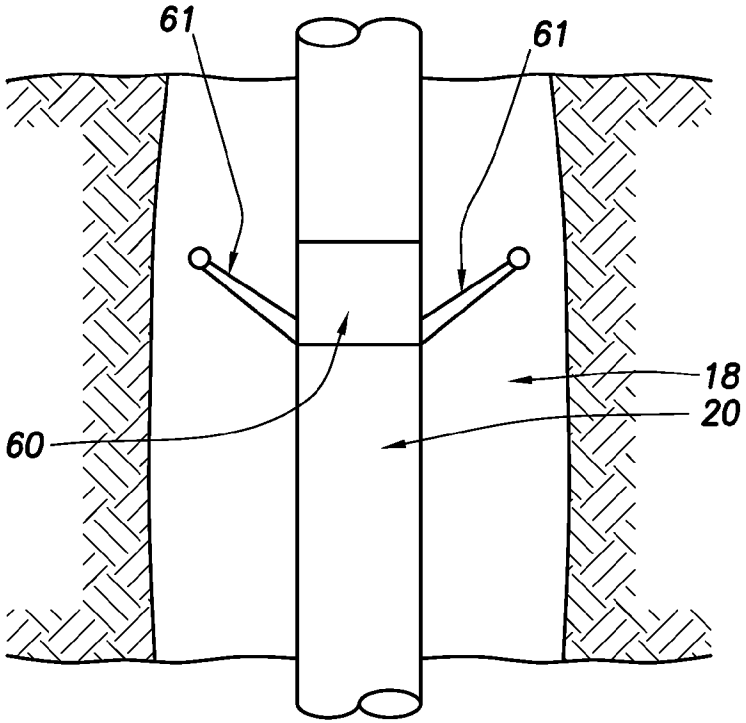

For example, as generally shown in FIGS. 6A and 6B, one or more of the tools 200 may be a caliper tool 60 which may have a caliper arm 61 which may extend from the caliper tool 60. The caliper tool 60 may be, for example, a tool which uses the caliper arm 61 to determine the diameter of the wellbore 18, to determine the diameter of a casing, to position a sensor adjacent to the wall of the wellbore, to detect a deformation in the wellbore 18, and/or the like. Examples of the caliper tool 60 are disclosed in U.S. Patent App. Pub. Nos. 2009/0242317 to Tashiro et al., 2008/0314587 to Del Campo et al., 2008/0296017 to Sonne et al., and 2008/0266577 to Prouvost et al. and U.S. Pat. Nos. 7,424,912 to Reid, 7,331,386 to Kanayama et al., 7,131,210 and 7,069,775 to Fredette et al., and 4,559,709 to Beseme et al., herein incorporated by reference in their entireties. The present invention is not limited to a specific embodiment of the caliper tool 60.

The motion response messages transmitted by the terminal 38 and/or the downhole processor 127 may control orientation of the caliper arm 61. For example, the motion response messages may retract the caliper arm 61 to prevent and/or to minimize contact of the caliper arm 61 with the wall of the wellbore 18. For example, the terminal 38 and/or the downhole processor 127 may automatically transmit the first motion response message if the terminal 38 and/or the downhole processor 127 determine that the platform 12 experiences heave and/or the drill string 20 has motion-induced axial stress. The terminal 38 and/or the downhole processor 127 may transmit the first motion response message to the caliper tool 60 using the wired drill pipe 100. The caliper tool 60 may retract the caliper arm 61 in response to the first motion response message.

Then, if the terminal 38 and/or the downhole processor 127 determine that the heave is completed and/or the motion-induced axial stress is removed, the terminal 38 and/or the downhole processor 127 may automatically transmit the second motion response message to the caliper tool 60 using the wired drill pipe 100. The caliper tool 60 may move the caliper arm 61 to an extended position in response to the second motion response message. Accordingly, the terminal 38 and/ or the downhole processor 127 may direct the caliper tool 60 to move the caliper arm 61 between an extended position shown in FIG. 6A and a retracted position shown in FIG. 6B in response to the motion and/or the axial stress.

FIG. 7 illustrates an embodiment of a sampling-while-drilling instrument 15 disposed in the drill string 20. The sampling-while-drilling instrument 15 may be one or more of the LWD instruments 10. An example of the sampling-while-drilling instrument 15 is described in U.S. Patent App. Pub. No. 2008/0156486 to Ciglenec et al., assigned to the assignee of the present invention and incorporated herein by reference in its entirety. The sampling-while-drilling instrument 15 may have a laterally extensible probe 36 for establishing fluid communication with a target formation 210 of the subsurface formations 11 and drawing formation fluid into sample chambers (not shown) in the sampling-while-drilling instrument as indicated by the arrows. The probe 36 may be positioned in a stabilizer blade 230 affixed to the exterior of the drill collar in which the sampling-while-drilling instrument 15 is disposed. The stabilizer blade 230 and/or the probe 36 may be moved into an extended position relative to the drill string 20 to engage the wall of the wellbore 18. The stabilizer blade 230 comprises one or more blades that may contact the wall of the wellbore 18.

The formation fluid drawn into the sampling-while-drilling instrument 15 using the probe 36 may be measured to determine, for example, pretest and/or pressure parameters. Additionally, the sampling-while-drilling instrument 15 may be provided with devices, such as, for example, the sample chambers, for collecting fluid samples for retrieval at the surface. Backup pistons 39 may laterally extend from an opposite side of the drill collar relative to the probe 36 to apply force to push the sampling-while-drilling instrument 15 and/or the probe 36 against the wall of the wellbore 18.

The sampling-while-drilling instrument 15 may be mechanically connected to one of the joints 22 of the drill string 20. In response to one or more of the control signals, the one of the joints 22 to which the sampling-while-drilling instrument 15 is mechanically connected may be rotated to align the probe 36 and/or the stabilizer blade 230 with an area of interest.

The motion response messages transmitted by the terminal 38 and/or the downhole processor 127 may control orientation of the probe 36, the stabilizer blade 230 and/or the backup pistons 39. For example, the motion response messages may retract the probe 36, the stabilizer blade 230 and/or the backup pistons 39 to prevent and/or to minimize contact of the probe 36, the stabilizer blade 230 and/or the backup pistons with the wall of the wellbore 18. For example, the terminal 38 and/or the downhole processor 127 may automatically transmit a first motion response message if the terminal 38 and/or the downhole processor 127 determine that the platform 12 experiences heave and/or the drill string 20 has motion-induced axial stress. The terminal 38 and/or the downhole processor 127 may transmit the first motion response message to the sampling-while-drilling instrument 15 using the wired drill pipe 100. The sampling-while-drilling instrument 15 may retract the probe 36, the stabilizer blade 230 and/or the backup pistons 39 in response to the first motion response message.

Then, if the terminal 38 and/or the downhole processor 127 determine that the heave is completed and/or the motion-induced axial stress is removed, the terminal 38 and/or the downhole processor 127 may automatically transmit a second motion response message to the sampling-while-drilling instrument 15 using the wired drill pipe 100. The sampling-while-drilling instrument 15 may move the probe 36, the stabilizer blade 230 and/or the backup pistons 39 to an extended position in response to the second motion response message. Accordingly, the terminal 38 and/or the downhole processor 127 may direct the sampling-while-drilling instrument 15 to move the probe 36, the stabilizer blade 230 and/or the backup pistons 39 between the extended position shown in FIG. 7 and a retracted position in response to the motion and/or the axial stress.

FIG. 8 illustrates an embodiment of a formation evaluation instrument 300. One or more of the LWD instruments may be the formation evaluation instrument 300. The formation evaluation instrument 300 may have a housing 301 configured for mechanical attachment to the drill string 20. The formation evaluation instrument 300 may have a probe assembly 307 and/or anchor pistons 311 located opposite to the probe assembly 307. The anchor pistons 311 may move to an extended position such that the anchor pistons 311 contact a wall 312 of the wellbore 18. Accordingly, the anchor pistons 311 may apply force to push the probe assembly 307 against the wall 312 of the wellbore 18.

The probe assembly 307 may be carried by the housing 301 and/or may be configured to seal a region 314 of the wall 312 of the wellbore 18 when urged against the wall 312. One or more actuators 316 may be used for moving the probe assembly 307 between a retracted position (not shown in FIG. 3) and an extended position (shown in FIG. 3) for sealing the region 314 of the wall 312 of the wellbore 18. The one or more actuators 316 may be a plurality of pistons connected to a probe pad 326 for moving the probe pad 326 between the retracted position and the extended position. The one or more actuators 316 may use a controllable power source (not shown), such as, for example, a hydraulic system, to extend and retract the plurality of pistons. The probe assembly 307 may have a packer 324, such as, for example, an elastomer ring or similar sealing element, which may be mounted to the probe pad 326 to create a seal between the wall 312 of the wellbore 18 and the region 314.

The probe assembly 307 may have a flexible drilling shaft 309 extending therefrom. A drill bit 308, such as, for example, an annular core bit, may be located at an end of the flexible drilling shaft 309. The drill bit 308 may be rotated and/or may be moved longitudinally by a motor assembly 302. The drill bit 308 may penetrate a formation 305 proximate the region 314. The flexible drilling shaft 309 may be guided through a suitably shaped tube 320 and/or may convey rotational and/or translational power to the drill bit 308 from the motor assembly 302. The drill bit 308 may create a lateral bore 310 extending partially through the formation 305 away from the wall 312 of the wellbore 18.

The formation evaluation instrument 300 may have a flow line 318 which may extend from a fluid reservoir 321, through a portion of the formation evaluation instrument 300 and in fluid communication with the formation 305, through the flexible drilling shaft 309 and out through an opening 322 in or defined by the flexible drilling shaft 309. The instrument 300 may have a pretest piston 315 hydraulically connected to the interior of the flexible drilling shaft 309 to perform fluid pressure tests, although the pretest piston 315 may be absent in some embodiments.

A pump 303 may be carried within the housing 301 for pumping fluid from a reservoir 321 into the formation 305. The pump 303 may be in communication with the formation 305 via the flow line 318 and the flexible drilling shaft 309. Additionally, instruments may be carried within the housing 301 for measuring pressure within the flexible drilling shaft 309 and/or in the reservoir 321. In some embodiments, a sensor 330 may be associated with the position of a barrier and/or a piston disposed in the reservoir 321 so that a volume of fluid displaced into the formation 305 through the probe assembly 307 may be monitored. In other embodiments, fluid may be moved from the reservoir 321 to the flexible drilling shaft 309 by applying hydrostatic pressure from within the wellbore 18 to one side of the piston in the reservoir 321, in addition to or in substitution of using the pump 303.

The flow line 318 may direct the fluid from the reservoir 321 through the lateral bore 310 into the formation 305. Formation evaluation may be performed at a plurality of depths for the lateral bore 310 by drilling the lateral bore 310 further into the formation 305 and repeating any testing. Preferably, the lateral bore 310 extends through the invaded zone laterally proximate the borehole 18 and into the uninvaded zone of the formation 305. As will be appreciated by those skilled in the art, the uninvaded zone includes substantially entirely connate fluid within the pore spaces of the formation 305. The lateral depth of the uninvaded zone from the wall 312 may depend on, among other factors, the fluid loss of the drilling fluid 30 used to drill the wellbore 18, the differential pressure between the hydrostatic (or hydrodynamic if performed during drilling) fluid pressure in the wellbore 18, the fluid pressure in the formation 305, and/or the porosity of the formation 305.

The formation evaluation instrument 300 may be mechanically connected to one of the joints 22 of the drill string 20. In response to one or more of the control signals, the one of the joints 22 to which the formation evaluation instrument 300 is mechanically connected may be rotated to align the probe assembly 307, the probe pad 326 and/or the flexible drilling shaft 309 with an area of interest.

The motion response messages transmitted by the terminal 38 and/or the downhole processor 127 may control orientation of the probe assembly 307, the anchor pistons 311, the one or more actuators 316, the probe pad 326 and/or the flexible drilling shaft 309. For example, the motion response messages may retract the probe assembly 307, the anchor pistons 311, the one or more actuators 316, the probe pad 326 and/or the flexible drilling shaft 309 to prevent and/or to minimize contact of the probe assembly 307, the anchor pistons 311, the one or more actuators 316, the probe pad 326 and/or the flexible drilling shaft 309 with the wall of the wellbore 18. For example, the terminal 38 and/or the downhole processor 127 may automatically transmit a first motion response message if the terminal 38 and/or the downhole processor 127 determine that the platform 12 experiences heave and/or the drill string 20 has motion-induced axial stress. The terminal 38 and/or the downhole processor 127 may transmit the first motion response message to the formation evaluation instrument 300 using the wired drill pipe 100. The formation evaluation instrument 300 may retract the probe assembly 307, the anchor pistons 311, the one or more actuators 316, the probe pad 326 and/or the flexible drilling shaft 309 in response to the first motion response message.

Then, if the terminal 38 and/or the downhole processor 127 determine that the heave is completed and/or the motion-induced axial stress is removed, the terminal 38 and/or the downhole processor 127 may automatically transmit a second motion response message to the formation evaluation instrument 300 using the wired drill pipe 100. The formation evaluation instrument 300 may move the probe assembly 307, the anchor pistons 311, the one or more actuators 316, the probe pad 326 and/or the flexible drilling shaft 309 to an extended position in response to the second motion response message. Accordingly, the terminal 38 and/or the downhole processor 127 may direct the formation evaluation instrument 300 to move the probe assembly 307, the anchor pistons 311, the one or more actuators 316, the probe pad 326 and/or the flexible drilling shaft 309 between the extended position shown in FIG. 8 and a retracted position in response to the motion and/or the axial stress.

The instruments shown in FIGS. 7 and 8 may be referred to as "station measurement" devices because they may perform their measurement and/or sample taking functions in a substantially fixed longitudinal position in the wellbore 18. It will be appreciated by those skilled in the art that operation of the previously described instruments may be substantially facilitated if the terminal 38 monitors operation of the various components of the instruments. For example, positions of pistons in the sample chambers, extension length of the probe, fluid pressures, and other parameters related to operation of the instruments may be monitored substantially in real time using the data transmitted to the terminal 38 by the wired drill pipe 100. Conversely, if a particular operation of the instrument must be initiated or terminated in response to the parameters being measured, such as, for example, extension of the probe by a certain distance as indicative of the end of probe drilling, the terminal 38 may transmit one or more of the control signals to the instruments using the wired drill pipe 100 to cause the desired operation, such as, for example, stopping drilling with the probe assembly 307.

As will be appreciated by those skilled in the art, the wired drill pipe 100 may provide high bandwidth telemetry which may enable LWD station measuring instruments to respond to surface generated commands in a manner substantially as is performed for wireline conveyed station measuring instruments. For example, by monitoring the various operating parameter measurements while the instrument is operated at the fixed position, problems may be avoided, such as, for example, failure of the packer 324 to exclude wellbore fluid from the probe 307. In such cases, the system user and/or the terminal 38 may observe measured pressure in the sample chamber rising more quickly than is consistent with flow from the formations. Such indication may prompt the system user and/or the terminal 38 to discard any fluid sample withdrawn and/or to attempt to re-set the instrument at a more suitable location. Without real time signal communication, occurrences, such as, for example, failure of the packer 324, would not be observable in real time, leaving open the possibility, for example, of the entire sample chamber being filled with drilling fluid, and such occurrence not being determinable until the entire instrument is withdrawn from the wellbore 18 by removing substantially the entirety of the drill string 20. Those skilled in the art will readily appreciate that the capability to observe station measurement operating parameters in real time may avoid measurement failure that goes unobserved until the instrument is withdrawn from the wellbore 18, thus materially increasing the expense associated with the station measurement operation.

Figure 9:
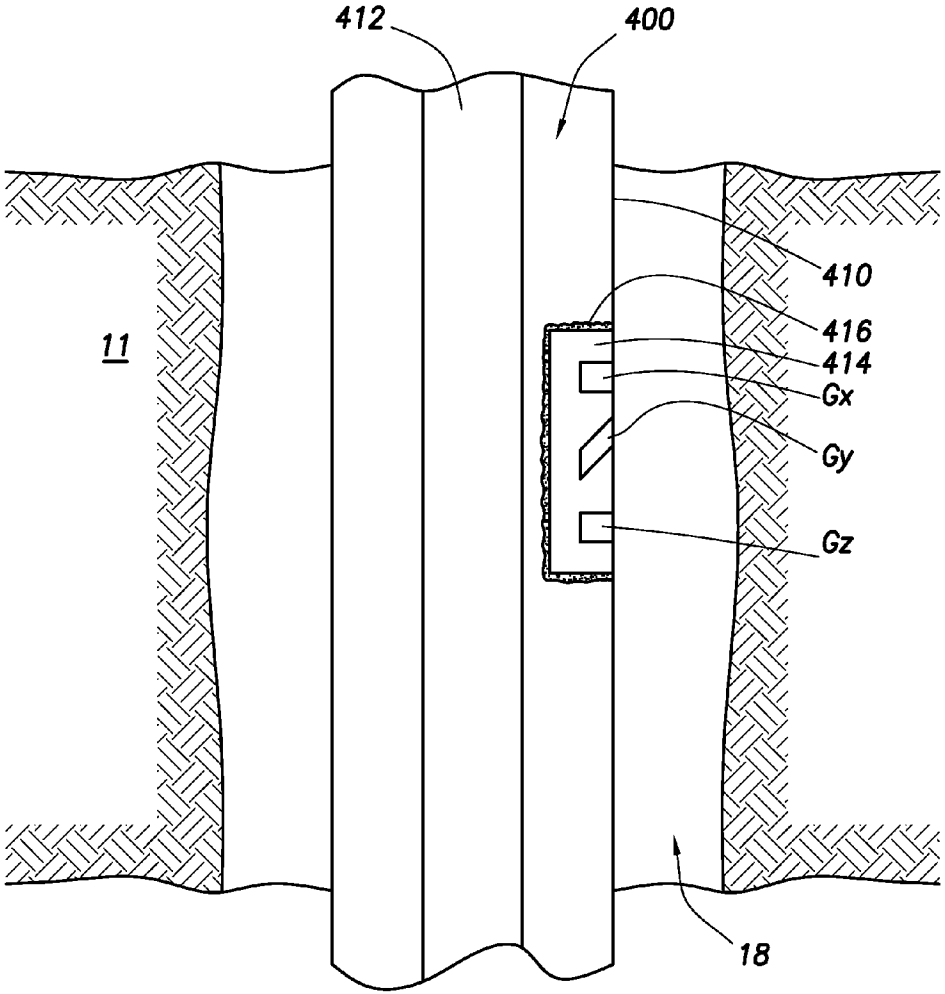

FIG. 9 generally illustrates a seismic receiver 400 which may function as a LWD station measuring instrument. The seismic receiver 400 may be disposed in a drill collar 410 that may be coupled by threads to the drill string 20. The drill collar 410 may have a centrally disposed conduit 412 for passage of the drilling fluid 30. A seismic sensor pad 414 may be made from low density metal, such as, for example, aluminum, and/or may be disposed in a recess in the exterior wall of the drill collar 410. An acoustic isolator 416 may mount the seismic sensor pad 414 in the collar recess so as to reduce transmission of acoustic energy from the drill collar 410 to the seismic sensor pad 414. The acoustic isolator 416 may be made from elastomer and/or a similar material. In the example in FIG. 9, three orthogonally disposed seismic sensors, such as geophones Gx, Gx, Gz may be disposed in the seismic sensor pad 414. The seismic sensor pad 414 may be urged into contact with the wall of the wellbore 18 if the instrument 400 is disposed at a selected position in the wellbore 18. The device used for urging the seismic sensor pad 414 into contact with the wall of the wellbore 18 is not a limit on the scope of the present invention and is not shown for clarity of the illustration.

The seismic receiver 400 may actuate a seismic energy source near the Earth's surface and/or may detect seismic energy resulting therefrom. The seismic receiver 400 may be positioned at a number of selected positions along the wellbore 18, and the foregoing procedure may be repeated at each of the selected positions to produced a vertical seismic profile ("VSP") survey. In response to one or more of the control signals, the drill collar 410 to which the seismic sensor 400 is mechanically connected may be rotated to align the seismic sensor pad 414 with the selected positions. As will be appreciated by those skilled in the art, the quality of seismic data is related to how well the seismic sensor pad 414 contacts the wellbore wall. In some cases, the contact is less than acceptable because of conditions of the wall of the wellbore 18 at the selected position. Using a method according to the invention, signals from the seismic sensors Gx, Gy, Gz may be communicated to the surface using the wired drill pipe 100. Therefore, the quality of the contact between the seismic sensor pad 414 and the wall of the wellbore 18 may be tested by operating the seismic energy source (not shown) and observing the waveforms of the detected seismic energy. The system user and/or the terminal 38 may take corrective action, such as, for example, by moving the seismic sensor 400 to a different position along the wellbore 18. It will be appreciated by those skilled in the art that such contact evaluation may be possible by the high bandwidth telemetry of the wired drill pipe 100.

The motion response messages transmitted by the terminal 38 and/or the downhole processor 127 may control orientation of the seismic sensor pad 414. For example, the motion response messages may retract the seismic sensor pad 414 to prevent and/or to minimize contact of the seismic sensor pad 414 with the wall of the wellbore 18. For example, the terminal 38 and/or the downhole processor 127 may automatically transmit a first motion response message if the terminal 38 and/or the downhole processor 127 determine that the platform 12 experiences heave and/or the drill string 20 has motion-induced axial stress. The terminal 38 and/or the downhole processor 127 may transmit the first motion response message to the seismic receiver 400 using the wired drill pipe 100. The seismic receiver 400 may retract the seismic sensor pad 414 in response to the first motion response message.

Then, if the terminal 38 and/or the downhole processor 127 determine that the heave is completed and/or the motion-induced axial stress is removed, the terminal 38 and/or the downhole processor 127 may automatically transmit a second motion response message to the seismic receiver 400 using the wired drill pipe 100. The seismic receiver 400 may move the seismic sensor pad 414 to an extended position in response to the second motion response message. Accordingly, the terminal 38 and/or the downhole processor 127 may direct the seismic receiver 400 to move the seismic sensor pad 414 between an extended position and a retracted position in response to the motion and/or the axial stress.

Accordingly, the motion response messages may control the motion compensation component 16 and/or the tools 200 to compensate for motion, such as, for example, heave experienced by the platform 12 and/or motion-induced axial stress applied to the drill string 20. The motion response messages may be transmitted using the wired drill pipe 100. The motion response messages may move a downhole tool between a retracted and an extended position. The motion response messages may start, stop, change and/or modify operation of the motion compensation component 16. For example, the motion response messages may direct the motion compensation component 16 to resist and/or enable compression or elongation of the drill string 20 and/or to change a length of the drill string 20. The motion compensation component 16 may prevent axial or rotational movement of a portion of the drill string 20 below the motion compensation component 16. Accordingly, the motion compensation component 16 may maintain a position of the tools 200 below the motion compensation component 16 and may enable the tools 200 to transmit the data to the surface during heave of the platform 12 and/or motion of the drill string 20.

It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the claims.

We claim:

1. A system for motion compensation in a wellbore, the system comprising:

a heave detector located adjacent to a platform and detects a heave;

a drill string extending into a wellbore from the platform, the drill string comprising at least a portion of a wired drill pipe having joints communicatively coupled; and a motion compensation component positioned within the wellbore and communicatively coupled to the drill string wherein receipt of a signal from the heave detector activates the motion compensation component to prevent axial or rotational movement of the drill string below the motion compensation component, wherein the motion compensation component is a slip joint coupled to the wired drill pipe.

2. The system of claim 1 wherein activation of the slip joint changes a length of the drill string.

3. The system of claim 1 further comprising:

a formation sampling tool within the wellbore communicatively connected to a terminal adjacent the platform by the wired drill pipe and having a stationary position maintained by the motion compensation component.

4. The system of claim 1 further comprising:

a terminal located on the platform and electrically connected to the wired drill pipe wherein the terminal receives heave measurements from the heave detector and transmits the signal to the motion compensation component using the wired drill pipe in response to the heave measurements.

5. An apparatus for motion compensation, the apparatus comprising:

a processor which determines as a platform experiences heave based on measurements obtained by sensors communicatively connected to the processor and automatically transmits a signal based on a determination that the platform experiences heave;

a downhole tool mechanically connected to a drill string located in a wellbore wherein the downhole tool receives the signal;

an arm mechanically connected to the downhole tool wherein the downhole tool moves the arm radially from a first position to a second position in response to the signal;

a portion of the drill string which comprises a wired drill pipe wherein the processor is located on the platform and further wherein the processor transmits the signal to the downhole tool using the wired drill pipe; and a slip joint coupled to the wired drill pipe to compensate the heave.

6. The apparatus of claim 5 wherein the downhole tool moves the arm from the second position to the first position in response to a subsequent signal.

7. The apparatus of claim 5 wherein the first position of the arm is an extended position relative to the downhole tool and the second position of the arm is a retracted position relative to the downhole tool.

8. The apparatus of claim 5 further comprising:

a heave sensor located adjacent to the platform wherein the processor determines as the platform experiences heave based on heave measurements transmitted to the processor from the heave sensor.

9. The apparatus of claim 5 further comprising:

a heave sensor mechanically connected to the drill string wherein the processor determines as the platform experiences heave based on heave measurements transmitted to the processor from the heave sensor and further wherein the heave sensor and the processor are located in the wellbore.

10. The apparatus of claim 5 wherein the downhole tool is at least one of a formation fluid tester, a seismic sensor and a formation core sample taking instrument.

* * * * *